US006398667B1

(12) United States Patent
Lemons

(10) Patent No.: US 6,398,667 B1
(45) Date of Patent: Jun. 4, 2002

(54) GOLF BALL WITH LATTICE STRUCTURE

(75) Inventor: Lane D. Lemons, Jackson, TN (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/589,722

(22) Filed: Jun. 8, 2000

(51) Int. Cl.[7] ..... A63B 37/04; A63B 37/06; A63B 37/08

(52) U.S. Cl. ..... 473/374; 473/373; 473/376; 473/370

(58) Field of Search ..... D21/708, 709; 473/351, 356, 361, 362, 363, 364, 366, 367, 368, 369, 370, 371, 374, 376, 601, 602, 605, 614

(56) References Cited

U.S. PATENT DOCUMENTS 1,182,604 A * 5/1916 Wadsworth ..... 473/377
1,855,448 A * 4/1932 Hazeltine ..... 473/377
4,431,193 A 2/1984 Nesbitt
4,848,770 A 7/1989 Shama
4,919,434 A 4/1990 Saito
5,304,608 A 4/1994 Yabuki et al.
5,314,187 A 5/1994 Proudfit
5,439,227 A 8/1995 Egashira et al.
5,490,674 A 2/1996 Hamada et al.
5,553,852 A 9/1996 Higuchi et al.
5,556,098 A 9/1996 Higuchi et al.
5,688,191 A 11/1997 Cavallaro et al.
5,704,854 A 1/1998 Higuchi et al.
5,759,676 A 6/1998 Cavallaro et al.
5,810,678 A 9/1998 Cavallaro et al.
5,813,923 A 9/1998 Cavallaro et al.
5,820,485 A * 10/1998 Hwang ..... 473/361
5,830,087 A 11/1998 Sullivan et al.
5,947,842 A 9/1999 Cavallaro et al.
5,965,669 A 10/1999 Cavallaro et al.
6,066,054 A 5/2000 Masutani
6,155,935 A * 12/2000 Maruko ..... 473/361

* cited by examiner

*Primary Examiner*—Jeanette Chapman
*Assistant Examiner*—Alvin A. Hunter, Jr.

(57) ABSTRACT

A golf ball is formed from a core, a lattice, and a cover which surrounds the lattice and the core. The lattice is provided with openings which expose portions of the core.

9 Claims, 3 Drawing Sheets

GOLF BALL WITH LATTICE STRUCTURE

BACKGROUND

This invention relates to golf balls, and, more particularly, to a golf ball which includes a lattice structure between the core and the cover.

Since the advent of the solid two-piece ball in the 1970's, different companies have tried to manufacture a solid ball with good spin characteristics, good distance, and good feel. Generally, with just a solid rubber core and a thermoplastic cover to work with, a golf ball developer can achieve two of these three attributes to one degree or another. For example, a designer can achieve good spin and distance, but at the detriment of feel. Likewise, a designer can achieve good feel and spin, but only with a loss of distance.

One method companies have used to overcome this shortfall of solid balls is the employment of double covers. Golf balls have been proposed which have two covers, one formed from a soft resin, the other formed from a hard resin. By using combinations of these different covers, some of the design constraints of the two-piece solid ball can be overcome. However, other disadvantages remain. For instance, if a designer uses a soft inner cover and hard outer cover, the ball still lacks adequate spin for certain types of products. If a designer uses a hard inner cover, and a soft outer cover, the product is essentially a distance two-piece ball with an outer cover over it.

Generally, the manufacture of these multi-covered balls encounters one of several problems. First, if both covers are thick enough to be injection molded, the total combined thickness of the two covers over the core is too large to achieve adequate feel, spin, and distance. If this total thickness is reduced, one of the covers must be thinned, and thus must either be compression molded or some type of manufacturing process, such as centerless grinding of the inner layer, must take place. This increases cost and complexity.

Some golf balls include a mantle layer between the core and the cover. The mantle layer may be formed from materials which are conventionally used in covers, for example, ionomer resins, or from materials which are conventionally used in cores, for example, polybutadiene. A mantle layer presents the same difficulties as an inner cover layer.

SUMMARY OF THE INVENTION

It is not essential that a full mantle or inner layer be molded on the core, rather just a substructure is sufficient. This substructure should accomplish several important objectives. First, it should provide adequate support for the typically solid rubber core during impact. It should hold the core substantially spherical in shape for maximum energy transfer during and after impact. Secondly, it should not require additional total cover thickness to achieve the desired initial velocity or distance. Thirdly, the substructure should either not, or only slightly, affect the feel and playability of the ball as detected by the golfer.

The invention provides this substructure as a lattice structure, which covers only portions of the core and leaves other portions of the core exposed. The lattice would be structural enough to provide the support required by the core during impact, but innocuous enough to not cause detriment to the playability aspects of the ball.

This lattice could come in any form and preferably comprises a series of bands about the core. In order to obtain some sort of symmetry about the sphere, the lattice may replicate one of the Platonic or Archimedean solids which is projected onto the surface of a sphere. The bands or lattice legs then occupy the same great circle paths as created by the boundary of the polyhedra of the solid. For example, for an octahedron, the lattice would entail three bands circumnavigating the ball, each at right angles from each other. Other solids which could be utilized include, but are not limited to, the cuboctahedron, the icosahedron, and the icosadodecahedron.

The lattice can be used with a homogenous or multi-layered core and with a homogeneous or multi-layered cover or combinations thereof.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
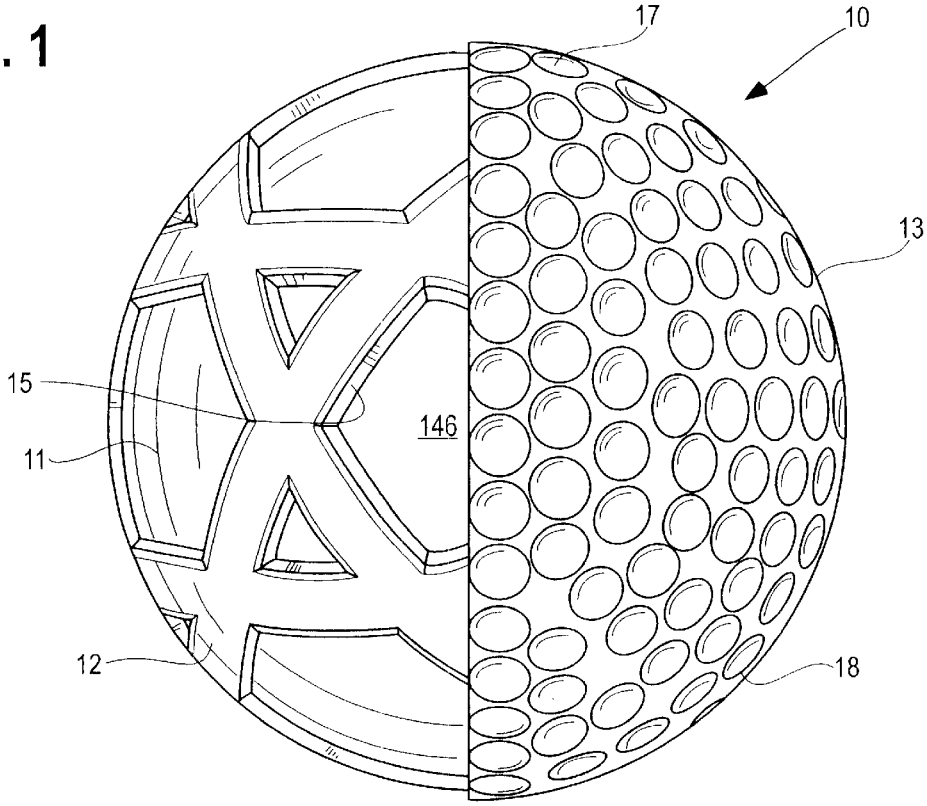
FIG. 1 is a fragmentary view of a golf ball which is formed in accordance with the invention and which has a portion of the cover removed to show the lattice structure.
Figure 6:
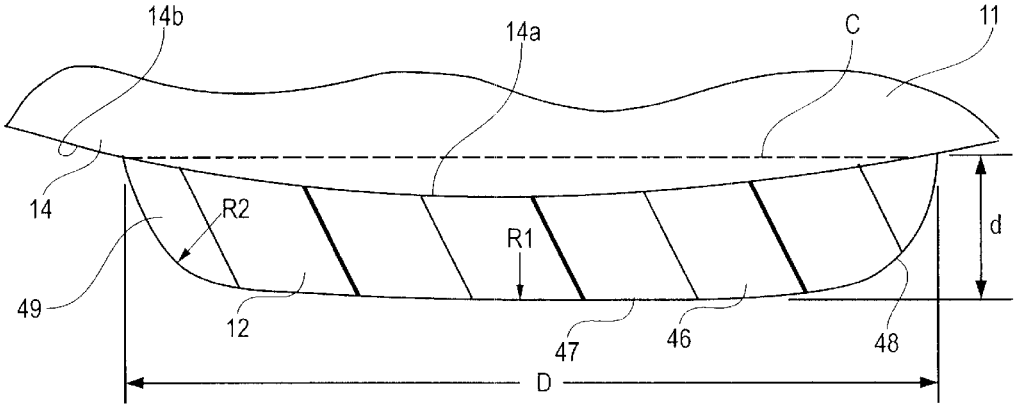
FIG. 6 is a fragmentary sectional view through one of the bands of the lattice structure.

FIG. 1 illustrates a golf ball 10 which includes a core 11, a lattice structure 12, and a cover 13. Referring also to FIG. 6, the core has a spherical outer boundary 14, and the lattice structure extends outwardly from portions 14*a* of the outer boundary of the cores. openings 15 in the lattice expose portions 14*b* of the outer boundary or surface of the core.

Figure 7:
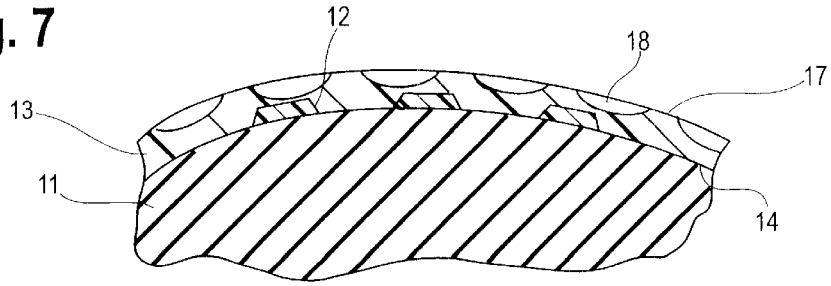
FIG. 7 is a fragmentary sectional view of a golf ball which includes a core, a lattice structure, and a cover.

The cover 13 surrounds the core and lattice structure. The cover includes a spherical outer surface 17 which is provided with dimples 18. Referring to FIG. 7, the cover extends downwardly into the openings 15 in the lattice to contact the exposed portions of the core.

Figure 2:
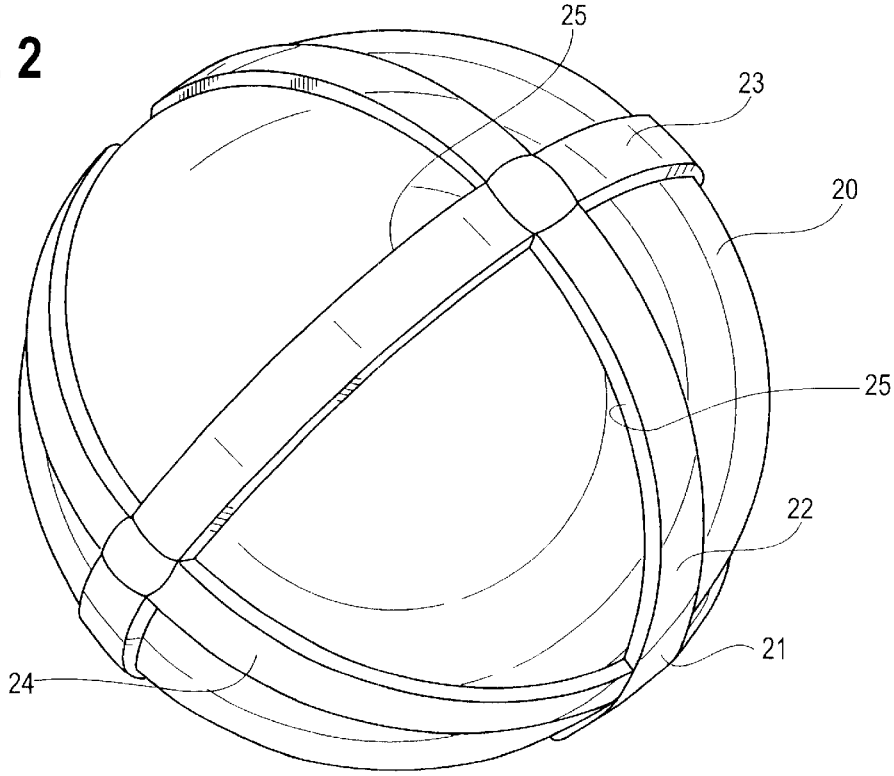
FIG. 2 illustrates a golf ball core and a lattice structure formed in the shape of a spherical octahedron.

FIG. 2 illustrates a core 20 and a lattice structure 21 which is formed by three intersecting bands or solid portions 22, 23, and 24 which extend at right angles to each other. The bands form a spherical octahedron on the core. A spherical octahedron is formed by projecting a solid octahedron onto the surface of a sphere. The bands 22–24 follow the great circle paths of the projected boundaries or intersections of the sides of the solid octahedron. The bands form openings 25 in the shape of spherical triangles which expose portions of the core.

If desired, the bands or lattice structure can be formed at the same time as the core by molding the core and bands integrally from the same material. The material can be molded in a two-part mold in which the surface of the mold cavity is provided with recesses in the shape of the bands. Referring to FIG. 6, even if the core and lattice are integral, the core is defined by the sphere 14, and the lattice projects outwardly from the sphere.

Alternatively, the lattice can be formed on the core after the core is molded. For example, a molded core can be positioned in a two-part mold in which the surface of the cavity includes spherical portions which contact the surface of the core and recesses which form the bands. The material for the lattice can be injected into the recesses of the mold.

The cover 13 is molded over the core and the lattice. The cover can be injection molded over the core and lattice, or the cover can be formed from half shells which are compression molded over the core and the lattice.

Figure 3:
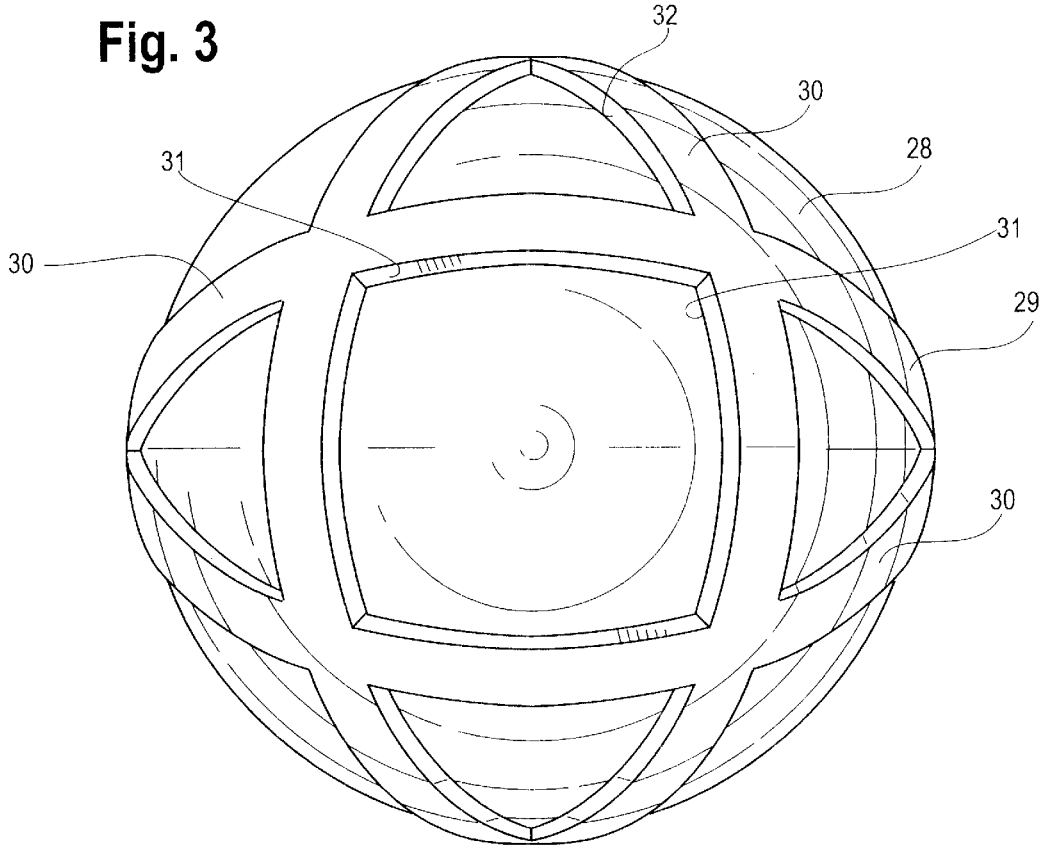
FIG. 3 is a view similar to FIG. 2 in which the lattice structure is in the shape of a spherical cubactahedron.

FIG. 3 illustrates a core 28 and a lattice 29 which is in the form of a spherical cuboctahedron. A spherical cuboctahedron is formed by projecting a solid cuboctahedron onto the surface of a sphere. The lattice 29 includes intersecting bands 30 which follow great circle paths and which form openings 31 and 32 in the shape of spherical rectangles and spherical triangles.

Figure 4:
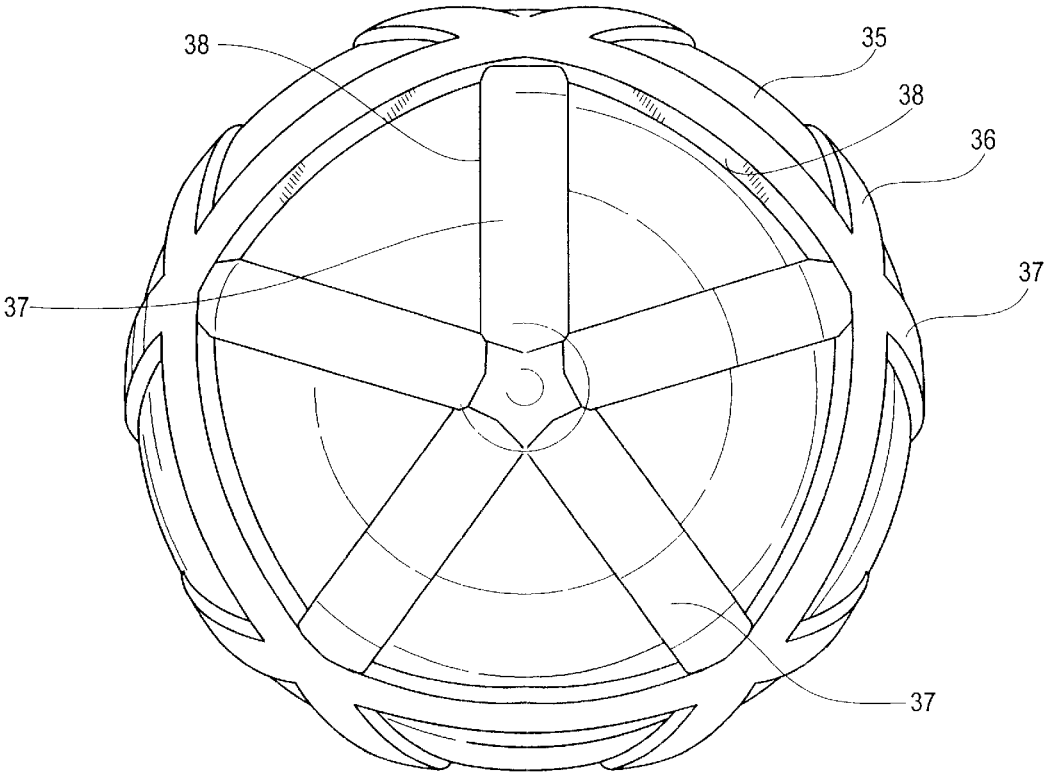
FIG. 4 illustrates a lattice structure in the shape of a spherical icosahedron.

FIG. 4 illustrates a core 35 and a lattice 36 which is formed in the shape of a spherical icosahedron. The lattice includes bands 37 which follow segments of great circle paths or geodesics. The bands form 20 openings 38 in the shape of spherical triangles.

Figure 5:
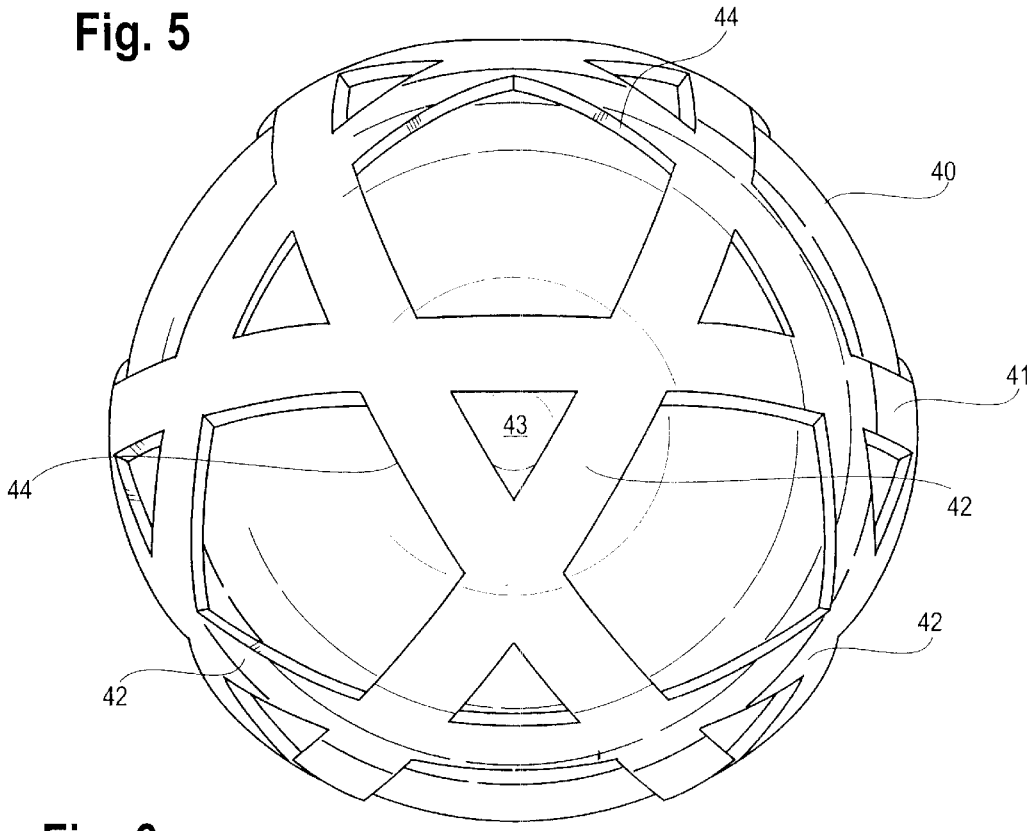
FIG. 5 illustrates a lattice structure in the shape of a spherical icosadodecadron.

FIG. 5 illustrates a core 40 and a lattice 41 which is formed in the shape of a spherical icosadodecadron. The lattice includes six bands 42 which follow great circle paths. The bands form 20 small spherical triangular openings 43 and 12 spherical pentagons 44. The lattice 12 of FIG. 1 is also in the form of an icosadodechadron.

FIG. 6 illustrates the cross sectional configuration of one embodiment of the bands 46 of the lattice. The band includes a curved outer surface 47 and a pair of curved side surfaces 48 and 49. The outer surface 47 has a radius $R_1$, and the side surfaces 48 and 49 have a radius $R_2$. Chord C is the distance between the intersections of the side walls with the spherical surface 14 of the core. The chord extends parallel to a tangent to the spherical surface at the middle of the band and has a length D. The depth d of the band is the dimension between the chord and the outermost point of the outer surface 47.

For a golf ball having a conventional diameter of 1.680 inches, the diameter of the spherical surface of the core can be within the range of 1.450 to 1.600 inches. The thickness or depth of the lattice can be within the range of 0.010 to 0.130 inch. The thickness of the cover in the openings of the lattice can be within the range of 0.080 to 0.230 inch, and the thickness of the cover over the solid areas of the lattice can be within the range of 0.070 to 0.220 inch. However, other dimensions can be used.

Each of the lattice structures which is illustrated in FIGS. 1–6 is formed from bands in the shape of a spherical projection of a solid having polygonal sides. However, the lattice can have other shapes. Both the portions of the lattice which cover the core and the openings in the lattice which expose the core can have any desired shape. However, lattice structures in the shape of Platonic or Archimedean solids provide advantageous symmetry.

The lattice covers enough of the core to provide structural support to the core when the golf ball is impacted with a golf club. The area of the core covered by the lattice structure will typically be between 15% and 85% of the total surface area of the core, with the most effective range being between 35% and 65%. However, the open area of the lattice is such that the cover can be thin enough to provide good feel and playability. The combined coefficient of restitution of the core, lattice, and cover is sufficient to provide advantageous initial velocity and distance. Initial velocity and overall distance can be measured in accordance with standard tests of the United States Golf Association.

The core, lattice, and cover can be made from a variety of materials depending upon the performance characteristics which are desired. The core will typically be compression molded from a homogeneous blend of conventional core material. However, the core could also be injection or transfer molded. The core is preferably formed from a composition which includes polybutadiene as the primary ingredient, a crosslinking agent such as zinc diacrylate, and other conventional core ingredients. The core could also be formed from two or more parts, for example, a center and an outer layer or mantle.

The lattice can be formed from the same or different material as the core. For example, the lattice can comprise primarily polybutadiene or can be formed primarily from cover-type materials such as ionomer resins, balata, and urethanes. Thermoplastic or thermosetting materials can be used.

The cover can be formed from any conventional cover material, for example, ionomer resins, balata, polyurethanes, mixtures thereof, or any other materials which could be used in golf ball covers.

Table I lists specific core formulations which are suitable for cores. Table II lists specific formulations which are suitable for lattice structures.

TABLE I

| Material | Parts By Weight |
|---|---|
| Rubber or Blend of Rubbers chosen from Polybuiadiene, Polyisoprene, Natural Rubber, Polyurethanes, etc. | 100 |
| Crosslinking Agent(s) | 10–50 |
| Free Radical Initiator | 0.5–5 |
| Fillers as needed to adjust weight ($CaCO_3$, $BaSO_4$, ZnO, Limestone, W, etc.) | |

TABLE II

Ionomers comprising 70–90% ethylene, 6–20% carboxylic acid, 0.23% alkyl arcylate. Materials of this type are supplied by DuPont (Surlyn™) and Exxon (Iotek™). The target hardness D in the range of 4075 Shore D. Blends of these materials can also be utilized.

Thermoplastic polyester elastomers. Materials of this type are supplied by DuPont under the trademark Hytrel. The target hardness is in the range of 30–70 Shore D.

Thermoplastic polyurethanes such as those available from B.F. Goodrich under the name Estane, or Morton International under the name Morthane. The target hardness is 30–70 Shore D.

Thermoset polyurethanes such as materials supplied by Bayer under nthe trademark Bayflex™. The target hardness is 30–70 Shore D.

Thermoset rubber compounds adhering to the basic formulation set out in Table I.

While in the foregoing specification, a detailed description of specific embodiments of the invention has been set forth for the purpose of illustration, it will be understood that many of the details hereingiven can be varied considerably by those skilled in the art without departing from the spirit and scope of the invention.

I claim:

1. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, a cover which surrounds the lattice and the core, the cover extending downwardly into the openings in the lattice and into contact with the exposed portions of the outer boundary of the core.

2. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, said bands forming a spherical Platonic solid, and a cover which surrounds the lattice and the core, the cover extending downwardly into the openings in the lattice and into contact with the exposed portions of the outer boundary of the core.

3. The golf ball of claim 2 in which said lattice is molded from a thermoplastic material.

4. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, said bands forming a spherical Archimedean solid, and a cover which surrounds the lattice and the core, the cover extending downwardly into the openings in the lattice and into contact with the exposed portions of the outer boundary of the core.

5. The golf ball of claim 4 in which said lattice is molded from a thermoplastic material.

6. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, said lattice and said core being molded integrally from the same material, and a cover which surrounds the lattice and the core, the cover extending downwardly into the openings in the lattice and into contact with the exposed portions of the outer boundary of the core.

7. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, said lattice being molded from a thermoset material, and a cover which surrounds the lattice and the core, the cover extending downwardly into the openings in the lattice and into contact with the exposed portions of the outer boundary of the core.

8. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, the lattice covering 15 to 85% of the surface area of the core, and a cover which surrounds the lattice and the core, the cover extending downwardly into the openings in the lattice and into contact with the exposed portions of the outer boundary of the core.

9. A golf ball comprising:

a core having a spherical outer boundary, a lattice extending outwardly from the outer boundary of the core, the lattice having solid portions which are secured to portions of the outer boundary of the core and openings which expose portions of the outer boundary of the core, the solid portions of the lattice comprising bands which extend around the outer boundary of the core, at least three of the bands extending along great circle paths, the lattice covering 35 to 65% of the surface area of the core, and a cover which surrounds the lattice and the core, the cover extending downwardly into the openings in the lattice and into contact with the exposed portions of the outer boundary of the core.

* * * * *